US009859042B2

(12) United States Patent
Luo et al.

(10) Patent No.: US 9,859,042 B2
(45) Date of Patent: Jan. 2, 2018

(54) RARE EARTH PERMANENT MAGNETIC POWDER, BONDED MAGNET AND DEVICE USING THE BONDED MAGNET

(75) Inventors: Yang Luo, Beijing (CN); Hongwei Li, Beijing (CN); Dunbo Yu, Beijing (CN); Kuoshe Li, Beijing (CN); Wenlong Yan, Beijing (CN); Jiajun Xie, Beijing (CN); Shuai Lu, Beijing (CN)

(73) Assignee: GRIREM ADVANCED MATERIALS CO., LTD., Beijing (CN)

( * ) Notice: Subject to any disclaimer, the term of this patent is extended or adjusted under 35 U.S.C. 154(b) by 598 days.

(21) Appl. No.: 14/380,060

(22) PCT Filed: Jul. 2, 2012

(86) PCT No.: PCT/CN2012/078077

§ 371 (c)(1),
(2), (4) Date: Aug. 20, 2014

(87) PCT Pub. No.: WO2014/005271

PCT Pub. Date: Jan. 9, 2014

(65) Prior Publication Data

US 2015/0040725 A1 Feb. 12, 2015

(51) Int. Cl.

| | |
|---|---|
| ***H01F 1/057*** | (2006.01) |
| ***H01F 1/059*** | (2006.01) |
| ***H01F 1/08*** | (2006.01) |
| ***C22C 38/00*** | (2006.01) |
| ***C22C 38/02*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |
| ***H01F 1/055*** | (2006.01) |
| ***C22C 38/16*** | (2006.01) |
| ***B22F 1/00*** | (2006.01) |
| *C22C 38/30* | (2006.01) |

(52) U.S. Cl.

CPC ..... *H01F 1/0578* (2013.01); *B22F 1/0018* (2013.01); *C22C 38/001* (2013.01); *C22C 38/002* (2013.01); *C22C 38/005* (2013.01); *C22C 38/02* (2013.01); *C22C 38/06* (2013.01); *C22C 38/10* (2013.01); *C22C 38/12* (2013.01); *C22C 38/14* (2013.01); *C22C 38/16* (2013.01); *H01F 1/059* (2013.01); *H01F 1/0551* (2013.01); *H01F 1/0571* (2013.01); *H01F 1/083* (2013.01); *B22F 2001/0033* (2013.01); *B22F 2998/10* (2013.01); *B22F 2999/00* (2013.01); *C22C 38/30* (2013.01)

(58) Field of Classification Search
None
See application file for complete search history.

(56) References Cited

U.S. PATENT DOCUMENTS

| | | | | |
|---|---|---|---|---|
| 5,482,573 A * | 1/1996 | Sakurada | ..... | H01F 1/055 148/301 |
| 5,968,290 A * | 10/1999 | Sakurada | ..... | H01F 1/059 148/301 |
| 6,468,440 B1 * | 10/2002 | Sakurada | ..... | H01F 1/059 148/101 |

FOREIGN PATENT DOCUMENTS

| | | |
|---|---|---|
| CN | 1195868 A | 10/1998 |
| CN | 1274933 A | 11/2000 |
| JP | 09298111 A | 11/1997 |
| JP | 11003812 A | 1/1999 |

OTHER PUBLICATIONS

State Intellectual Property Office of the P.R. China. International Application No. PCT/CN2012/078077. International Search Report dated Apr. 4, 2013. Chinese Language. 3 pages.
State Intellectual Property Office of the P.R. China. International Application No. PCT/CN2012/078077. International Search Report dated Apr. 4, 2013. English Language Translation. 3 pages.

* cited by examiner

*Primary Examiner* — Roy King
*Assistant Examiner* — Ngoclan T Mai
(74) *Attorney, Agent, or Firm* — Moore & Van Allen PLLC; Henry B. Ward, III

(57) ABSTRACT

The application discloses a rare-earth permanent magnetic powder, a bonded magnet, and a device using the bonded magnet. The rare-earth permanent magnetic powder comprises 4 to 12 at. % of Nd, 0.1 to 2 at. % of C, 10 to 25 at. % of N and 62.2 to 85.9 at. % of T, wherein T is Fe or FeCo and the main phase of the rare-earth permanent magnetic powder is a hard magnetic phase with a $TbCu_7$ structure. Material volatilization can be avoided effectively during a preparation process of the rare earth permanent magnetic powder, thus improving the wettability with a water-cooling roller during the preparation process and final prepared materials are provided with good magnetic properties.

15 Claims, No Drawings

RARE EARTH PERMANENT MAGNETIC POWDER, BONDED MAGNET AND DEVICE USING THE BONDED MAGNET

TECHNICAL FIELD

This application relates to the field of rare-earth permanent magnetic materials, and in particular relates to a rare-earth permanent magnetic powder, a bonded magnet, and a device using the bonded magnet.

BACKGROUND

Due to advantages of good formability, high dimensional precision, high magnetic properties or the like, rare-earth bonded permanent magnets have been widely used in fields including various electronic equipment, office automation, automobiles etc., especially in micro-special motors. In order to meet the requirements of equipment miniaturization and microminiaturization in scientific and technological development, it is necessary to further optimize the properties of bonded magnetic powder.

The key to prepare a bonded rare-earth permanent magnet is a preparation of rare-earth permanent magnetic powder. The properties of the magnetic powder determine the quality and market price of the bonded magnet directly. Mature bonded rare-earth permanent magnets in the early market are basically isotropic bonded NdFeB magnets. This kind of widely used NdFeB magnetic powder is generally prepared by a rapid quenching method. Such NdFeB magnets have good properties. However, as patent products, the NdFeB magnets have been controlled by a few companies. In order to extend the application of rare-earth bonded permanent magnetic products further, people have been struggling to find more new bonded permanent magnetic powder products in recent years. Bonded permanent magnetic powder including HDDR (hydrogenation-disproportionation-desorption-recombination) isotropic powder, $Th_2Zn_{17}$-type isotropic powder, $TbCu_7$-type isotropic powder and $ThMn_{12}$-type isotropic powder etc. has attracted much attention of people.

Currently, samarium-iron-nitrogen-series rare-earth permanent magnetic powder has attracted wide attention because of its excellent properties. During a preparation process of the SmFe-series alloy, a rapidly quenched magnetic powder with a $TbCu_7$-structure hard magnetic phase is prepared through a strip casting technique. However, the preparation process, especially an industrial process has the following problems:

(1) samarium, with a low vapor pressure, is seriously volatile during the preparation process, thus causing unstable alloy preparation costs; the volatilized samarium, which is easily oxidized, is easy to catching fire and cause safety accidents; the volatilized samarium blocks a pipeline, which greatly damages a vacuum system;

(2) the highly viscous samarium alloy with bad wettability with a copper wheel during the rapid quenching process is easy to cause alloy liquid splashing, unstable liquid flows on the surface of a strip casting and unevenness of the surface to further cause an uneven alloy phase structure and microstructure, reducing the magnetic properties of the prepared samarium-iron-nitrogen-series rare-earth permanent magnetic powder. This is also a major reason that influences large scale application of the material currently.

In order to solve these problems encountered during the preparation process of the samarium iron alloy, it is a new subject in the field of rare-earth permanent magnetic powder development to find a kind of new rare-earth permanent magnetic powder with better magnetic properties.

SUMMARY

A rare-earth permanent magnetic powder, a bonded magnet, and a device using the bonded magnet are provided for improving the magnetic properties of the rare-earth permanent magnetic powder.

Therefore, the application provides a rare-earth permanent magnetic powder, which comprises 4 to 12 at. % of Nd, 0.1 to 2 at. % of C, 10 to 25 at. % of N and 62.2 to 85.9 at. % of T. T is Fe or FeCo and the main phase of the rare-earth permanent magnetic powder is a hard magnetic phase with a $TbCu_7$ structure.

Further, the rare-earth permanent magnetic powder has the structure in General Formula (I), and General Formula (I) is shown as follows:

$$Nd_xT_{100-x-y-a}C_yN_a \quad \text{(I)},$$

wherein $4 \le x \le 12$, $0.1 \le y \le 2$ and $10 \le a \le 25$.

Further, the rare-earth permanent magnetic powder further comprises 1 to 5 at. % of element A and 0.1 to 2 at. % of element B. Element A is Zr and/or Hf, the ratio of the content of element B to the content of element A is 0.1 to 0.5.

Further, the content of B in the rare-earth permanent magnetic powder ranges from 0.3 to 2 at. %.

Further, the contents of element Nd and element A in the rare-earth permanent magnetic powder are 4 to 12 at. % of the total contents of the rare-earth permanent magnetic powder, and the ratio of the content of element C to the sum of the contents of element Nd and element A in the rare-earth permanent magnetic powder is 0.03 to 0.15.

Further, the ratio of the content of element C to the sum of the contents of element Nd and element A in the rare-earth permanent magnetic powder is 0.05 to 0.12.

Further, the rare-earth permanent magnetic powder has the structure in General Formula (II), and General Formula (II) is shown as follows:

$$Nd_xA_wT_{100-x-y-z-a}C_yB_zN_a \quad \text{(II)}$$

wherein T is Fe or FeCo; A is Zr and/or Hf; $4 \le x+w \le 12$, $1 \le w \le 5$, $0.1 \le z \le 2$, $10 \le a \le 25$, $0.1 \le z/w \le 0.5$ and $0.1 \le y \le 2$.

Further, the rare-earth permanent magnetic powder further comprises 0.3 to 10 at. % of M, and M is at least one of Ti, V, Cr, Ni, Cu, Nb, Mo, Ta, W, Al, Ga and Si.

Further, the content of M in the rare-earth permanent magnetic powder is 0.5 to 8 at. %.

Further, the content of M in the rare-earth permanent magnetic powder is 0.5 to 5 at. %, and M is at least one of Nb, Ga, Al and Si.

Further, the roller contact surface roughness Ra of the rare-earth permanent magnetic powder is below 2.8 μm. Preferably, the roller contact surface roughness Ra is below 1.6 μm.

Preferably, the average grain size of the rare-earth permanent magnetic powder is 3 to 100 nm.

Further, element Nd in the rare-earth permanent magnetic powder is partly substituted by Sm and/or Ce. The content of Sm and/or Ce in the rare-earth permanent magnetic powder is 0.5 to 4.0 at. %.

A bonded magnet is further provided in the application. The bonded magnet is obtained by bonding the rare-earth permanent magnetic powder with a binder.

A device which uses the bonded magnet is further provided in the application.

The application has the following beneficial effect: in the rare-earth permanent magnetic powder, the bonded magnet, and the device using the bonded magnet of the application, material volatilization can be avoided effectively in the preparation process of the rare-earth permanent magnetic powder, thus improving the wettability with a water-cooling roller during the preparation process and final prepared materials are provided with good magnetic properties.

DETAILED DESCRIPTION

It should be noted that when there is no conflict, embodiments in the application and characteristics in the embodiments can be combined with each other. The application will be described in details with reference to specific embodiments hereinafter.

A nitrogen-series rare-earth permanent magnetic powder is basically prepared based on samarium and iron. This is because, among all rare-earth compounds, only nitrides of samarium-series alloys are easy axis-anisotropic so as to form a material with certain permanent magnetic properties. Other rare-earth iron alloys, which are all basal plane-anisotropic, will not have permanent magnetic properties even if being nitrided. Therefore, addition of other rare-earth elements may reduce the magnetic properties of samarium-iron-nitrogen magnetic powder greatly instead of providing permanent magnetic properties of rare-earth permanent magnetic powder.

Taught by the theory above, the inventor had tried many methods in N-series rare-earth permanent magnetic powder based on samarium and iron in order to solve the disadvantage that the magnetic properties of the prepared samarium-iron-nitrogen-series rare-earth permanent magnetic powder are reduced due to bad wettability of the samarium-iron-nitrogen-series rare-earth permanent magnetic powder with a water-cooling roller, but none of any improvements has been achieved. Therefore, researches on such inventions were stagnant for a long time.

The inventor mixed element Nd, element C, element N and element Fe by chance to prepare rare-earth permanent magnetic powder taking a hard magnetic phase with a $TbCu_7$ structure as the main phase through a rapid quenching process. Surprisingly, the wettability between the obtained rare-earth permanent magnetic powder and the water-cooling roller has been improved, which improves the magnetic properties of the prepared samarium-iron-nitrogen-series rare-earth permanent magnetic powder. Such change may be due to an NdFe alloy having a metastable state $TbCu_7$ structure hard magnetic phase formed in the preparation process through non-equilibrium solidification. Such a NdFe alloy having a metastable state $TbCu_7$ structure hard magnetic phase is uniaxial anisotropic. After being crystallized, the rapidly-quenched alloy is provided with certain hard magnetic properties. In addition, after nitridation, coercivity of the rapidly-quenched alloy has be improved to obtain a rare-earth permanent magnetic material with practical value.

In a example embodiment of the application, a rare-earth permanent magnetic powder includes 4 to 12 at. % of Nd, 0.1 to 2 at. % of C, 10 to 25 at. % of N and 62.2 to 85.9 at. % of T, wherein T is Fe or FeCo, and the main phase of the rare-earth permanent magnetic powder is a hard magnetic phase with a $TbCu_7$ structure.

The rare-earth permanent magnetic powder takes a neodymium-series iron alloy as a basic ingredient with a certain amount of element C. Synergetic addition of element Nd and element C can effectively reduce material volatilization during a smelting process of the alloy to further improve the wettability of the rare-earth permanent magnetic powder with a water-cooling roller during a rapid quenching process so that the final rapidly-quenched alloy is provided with stable alloy components, structure and surface state.

In the rare-earth permanent magnetic powder, the content of rare-earth Nd is in the range of 4 to 12 at. %. More α-Fe phases are formed in the rare-earth permanent magnetic powder when the content of Nd is less than 4 at. %, which greatly reduces the coercivity. However, more re-rich phases will be formed when the content of Nd is higher than 12 at. %, which is unfavourable for the improvement of magnetic properties. Preferably, the content of rare-earth Nd is 4 to 10 at. %.

In the rare-earth permanent magnetic powder, the content of C (carbon) is in the range of 0.1 to 2 at. %, preferably 0.3 to 1.5 at. %. C is added to improve the coercivity of the rare-earth permanent magnetic powder, and compounded with element Nd to improve the material surface state and obtain stable alloy components and structure finally.

In the rare-earth permanent magnetic powder, T is Fe, or Fe and Co. A certain amount of Co is added to improve the remanence and temperature stability of nitrogen-containing magnetic powder. At the same time, a metastable state $TbCu_7$ phase structure can be stabilized to improve effects including wettability etc. during the preparation process. Considering reasons including costs etc., the adding amount of Co is preferably not larger than 20 at. % of the content of T.

The rare-earth permanent magnetic powder is nitrided to obtain rare-earth permanent magnetic powder. The introduction of N (nitrogen) increases the distance between Fe—Fe atoms so as to greatly improve the Fe—Fe atom exchange interaction while improving both the Curie temperature and the coercivity. In the rare-earth permanent magnetic powder, the content of nitrogen is 10 to 25 at %. Too little added nitrogen will fail to increase the atom distance and improve the magnetic properties while too much added nitrogen will occupy unfavorable crystal sites instead to have negative impact on the final magnetic properties.

The main phase of the rare-earth permanent magnetic powder is the hard magnetic phase with the $TbCu_7$ structure. The main phase refers to a phase with the largest volume ratio in the material. Due to reasons including composition deviation and oxidation etc., other impurity phases may be introduced during the material preparation process. Powder constituent phases in the application are verified by X-Ray Diffraction (XRD) and all impurity phases are those which cannot be distinguished through X-ray.

In a embodiment of the application, the rare-earth permanent magnetic powder has the structure of General Formula (I). General Formula (I) is as follows:

$$Nd_xT_{100-x-y-a}C_yN_a \quad (I)$$

Wherein, $4 \le x \le 12$, $0.1 \le y \le 2$ and $10 \le a \le 25$. The rare-earth permanent magnetic powder with General Formula (I) has good wettability with the water-cooling roller and the final prepared rare-earth permanent magnetic powder has an advantage of good magnetic properties.

In a example embodiment of the application, the rare-earth permanent magnetic powder further contains 1 to 5 at. % of element A and 0.1 to 2 at. % of element B. Element A is Zr and/or Hf. The ratio of the content of B to the content of element A is 0.1 to 0.5.

In this rare-earth permanent magnetic powder, element A, i.e. element Zr and/or Hf is added, which is beneficial to improve the proportion of rare-earth elements in the alloy so as to stabilize the hard magnetic phase with the $TbCu_7$ structure while obtaining higher remanence. Preferably, the content range of A is controlled to be 1 to 5 at. %. The phase structure stabilizing effect is not obvious if the content of A is too little while too much A content will increase the costs on one hand and is unfavorable for improvement of the magnetic properties on the other hand.

At the same time, the addition of B (boron) to the rare-earth permanent magnetic powder is beneficial to improve the glass forming ability of the alloy, which can accelerate the formation of a material with relatively high properties at a relatively low copper wheel revolving speed. At the same time, a certain amount of B is added, which is beneficial to refine grain size and improve magnetic property parameters including remanence etc. of the material. It is required by the application that the range of the content range of B is 0.1 to 2 at. %, preferably 0.3 to 2 at. %, and more preferably 0.5 to 1.5 at. %. Too much B will result in an $Nd_2Fe_{14}B$ phase in the material, which is unfavorable for the improvement of the overall magnetic properties.

In addition, the ratio of the content of the added element A to the content of the added element B in the rare-earth permanent magnetic powder of the application is 0.1 to 0.5. The contents of A and B in the rare-earth permanent magnetic powder is in the ratio range above, which is beneficial to improve the material properties of the rare-earth permanent magnetic powder synergistically with an effect which is more obvious than that achieved by using the two separately. This is because it has been mentioned above that too much B will result in the $Nd_2Fe_{14}B$ phase in the material easily, though the addition of B can effectively improve the rapidly-quenched glass forming ability of the material. Therefore, the improvement of the overall magnetic properties is hindered. When the contents of A and B are added in a compounded manner in a certain composition proportion, the content of B may be increased relatively to avoid a bad phase so as to further improve the preparation performance and final magnetic properties of the material. Preferably, the content of element B is 0.3 to 2 at. %.

In a preferred embodiment of the application, the contents of element Nd and element A in the rare-earth permanent magnetic powder are 4 to 12 at. % of the total content of the rare-earth permanent magnetic powder, and the ratio of the content of element C to the sum of the contents of element Nd and element A in the rare-earth permanent magnetic powder is 0.03 to 0.15. The contents of element Nd and element A in the rare-earth permanent magnetic powder is controlled to be 4 to 12 at. % of the total content of the rare-earth permanent magnetic powder, which is beneficial to obtain a permanent magnetic material with a single $TbCu_7$ phase structure. At the same time, the ratio of the content of element C to the sum of the contents of element Nd and element A in the rare-earth permanent magnetic powder is controlled to be 0.03 to 0.15, and the ratio range of the two is regulated, which is beneficial reduce $Nd_2Fe_{14}C$ phases formed due to the addition of element C so that the alloy phase structure is more stable and the overall properties of the material can be improved. Preferably, the ratio is 0.05 to 0.12.

In a example embodiment of the application, the rare-earth permanent magnetic powder has the structure in General Formula (II) and the General Formula (II) is shown as follows:

$$Nd_xA_wT_{100-x-y-z-a}C_yB_zN_a \quad \text{(II)}$$

wherein T is Fe or FeCo; A is Zr and/or Hf; $4 \le x+w \le 12$, $1 \le w \le 5$, $0.1 \le z \le 2$, $10 \le a \le 25$, $0.1 \le z/w \le 0.5$ and $0.1 \le y \le 2$. This rare-earth permanent magnetic powder has the advantages of good wettability with the water-cooling roller and good magnetic properties of the final prepared rare-earth permanent magnetic powder.

In a example embodiment of the application, the rare-earth permanent magnetic powder further contains 0.3 to 10 at. % of M, and M is at least one of Ti, V, Cr, Ni, Cu, Nb, Mo, Ta, W, Al, Ga and Si. In this rare-earth permanent magnetic powder, the addition of element M can refine grain size, and improve magnetic properties including the final rare-earth permanent magnetic powder coercivity and remanence etc. Preferably, the content of element M is 0.5 to 8 at. %. More preferably, the content of M in the rare-earth permanent magnetic powder is 0.5 to 5 at. % and M is at least one of Nb, Ga, Al and Si.

By selecting different raw materials, other phase structures, e.g. a $ThMn_{12}$ structure and a $Th_2Zn_{17}$ structure besides the hard magnetic phase with the $TbCu_7$ structure can be hardly avoided in the material during the preparation process of the rare-earth permanent magnetic powder. In a preferred embodiment, the hard magnetic phase with the $TbCu_7$ structure of the rare-earth permanent magnetic powder has a peak between $2\theta=40°$ to 45° under Cu target X-ray. Preferably, when the XRD accuracy is 0.02° and the half peak width of the rare-earth permanent magnetic powder is less than 0.8°, the rare-earth permanent magnetic powder which satisfies the requirements above has single and stable phase structure, and good magnetic properties.

In the preparation of the rapidly-quenched alloy of the rare-earth permanent magnetic powder, the wettability between the alloy liquid and the water-cooling roller directly influences the surface roughness of the prepared alloy. The larger the roughness Ra value is, the more uneven the surface is. Since flakes with different thicknesses have different cooling rates. Some parts of the same flake have been over-quenched rapidly while the cooling rates of other parts are insufficient under extreme conditions. Therefore, phase structures and microstructures of the finally formed alloy are affected inevitably. In addition, a non-uniform flake also results in different dynamic conditions during a nitridation process to cause non-uniform nitridation. The final magnetic properties of the material are influenced by all factors above.

In order to further improve the magnetic properties of the rare-earth permanent magnetic powder provided by the application, the roller contact surface roughness Ra of the rare-earth permanent magnetic powder is below 2.8 μm in a example embodiment of the application. The roller contact surface roughness Ra in the application is the arithmetical mean deviation of the Contour, indicating the surface state of the flake. The arithmetical mean deviation of the Contour Ra is the arithmetic average of the absolute values of the Contour offset distance within the sampling length L, and the calculation formula is as follows:

$$R_a = \frac{1}{L}\int_0^L |y(x)|\,dx$$

or approximate to $$R_a = \frac{1}{L}\sum_{i=1}^{L} |y_i|$$

In the formulae above, y is the Contour offset distance, referring to the distance between a Contour point and a reference line in the measurement direction. The reference line is the central line of the Contour. The Contour is divided by this line, and the quadratic sum of the Contour offset distance from the line within the sampling length is minimal.

The roller contact surface roughness Ra of the rare-earth permanent magnetic powder is controlled below 2.8 μm, which is beneficial to control the material wettability reaction of the rare-earth permanent magnetic powder to further obtain rare-earth permanent magnetic powder with relatively high magnetic properties. Preferably, the roller contact surface roughness Ra of the rare-earth permanent magnetic powder is controlled below 2.8 μm; more preferably, the roller contact surface roughness Ra of the rare-earth permanent magnetic powder is 2.2 μm; and further preferably, the roller contact surface roughness Ra of the rare-earth permanent magnetic powder is below 1.6 μm.

In a example embodiment of the application, the average grain size of the rare-earth permanent magnetic powder is 3 to 100 nm. When the average grain size of the hard magnetic phase in the rare-earth permanent magnetic powder is smaller than 3 nm, a coercivity above 5 kOe can be hardly obtained while the rare-earth permanent magnetic powder is difficult to prepare to reduce the yield. If the average grain size is larger than 100 nm, the obtained remanence is relatively low. The grain size of the hard magnetic phase is preferably in the range of 5 to 80 nm, more preferably in the range of 5 to 50 nm.

In a preferred embodiment of the application, element Nd in the rare-earth permanent magnetic powder is partly substituted by Sm and/or Ce. The content of Sm and/or Ce in the rare-earth permanent magnetic powder is 0.5 to 4.0 at. %. Sm and/or Ce are/is added to the rare-earth permanent magnetic powder to improve the material properties and reduce the costs on one hand, and improve phase-forming conditions and surface state of the flake on the other hand.

A preparation process of the rare-earth permanent magnetic powder is further provided in the application, specifically using the following steps:

(1) firstly proportioning materials for an alloy with certain components, smelting the materials through methods including medium-frequency processing and electric arc processing etc. to obtain alloy ingots; (2) performing induction melting for coarsely crushed alloy blocks to form an alloy liquid and quenching the alloy liquid to obtain flaky alloy powder; (3) performing crystallization treatment for the obtained alloy powder at a certain temperature for a certain period of time, and then performing nitriding treatment and/or carburization treatment at about 350 to 550° C., the nitrogen source is a mixed gas of pure industrial nitrogen, hydrogen and ammonia etc.; Step 4: obtaining the rare-earth permanent magnetic powder.

With the material components disclosed above, all processes including rapid quenching, crushing, crystallization, and nitridation etc. in the whole preparation process of the material need to be controlled stably and uniformly. In the rapid quenching stage, factors which need to be controlled strictly include: the smelting temperature, the nozzle diameter and the rapid quenching wheel speed, and the jet pressure is controlled synergistically.

The jet pressure mainly has two functions in the application, one of which is to ensure stable and uniform ejection of the alloy liquid and the other function is to inhibit volatilization of elements, especially rare-earth elements during the smelting process to ensure the consistency of the material components. At the same time, the jet pressure is regulated continually according to the amount of the alloy liquid and rapid quenching conditions so as to avoid non-uniformity of materials prepared in different stages in a preparation process. During the initial stage of rapid quenching, a relatively small jet pressure may be applied at the moment because the pressure caused by the molten metal steel can ensure smooth ejection. In the middle and later stages of rapid quenching, because of slow liquid flows or even ejection difficulty caused by lowering of the molten steel level, the jet pressure is increased at the moment to ensure smooth rapid quenching.

The smelting temperature is also an important reference index. The smelting temperature of an NdFe-based alloy is relatively low. At the same time, a certain amount of M is added to effectively reduce the smelting temperature so that the whole process is stable, and volatilization can be hardly caused at the same time. In the application, the smelting temperature is between 1200° C. and 1600° C. and adjusted finely according to different components.

In the crystallization and nitridation stages, the treatment temperature and time need to be controlled in order to prevent grain growth of soft and hard magnetic phases. At the same time, improvement of crystallization and nitridation efficiency is one of the key factors to avoid abnormal grain growth. The application uses a relatively low-temperature and long-time treatment process to obtain magnetic powder with high properties on the basis of maintaining good microstructures.

The application provides the rare-earth permanent magnetic powder with the $TbCu_7$ structure as the main phase. An isotropic bonded magnet may be prepared by mixing the rare-earth permanent magnetic powder with a resin to prepare. The preparation method may include mould pressing, injection, calendering, and extrusion etc. and the prepared bonded magnet may be in other forms including a block shape and a ring shape etc.

The bonded magnet obtained by the application may be applied to preparation of a corresponding device. The rare-earth permanent magnetic powder with high properties and the magnet prepared by the methods above is beneficial to miniaturization of the device.

The beneficial effect of the rare-earth permanent magnetic powder provided by the application will be further described below in combination with specific embodiments S1 to S71.

It is verified by XRD that the main phases of hard magnet phases in rare-earth permanent magnetic powder prepared by the following embodiments S1 to S71 are $TbCu_7$ structures. Components, grain sizes, grain distribution, and magnetic powder properties of the rare-earth permanent magnetic powder will be further described below.

(1) Rare-earth Permanent Magnetic Powder Components

Rare-earth alloy powder components are prepared by nitriding smelted alloy powder and magnetic powder components are nitrided magnetic powder components expressed by atom percentages.

(2) Grain Size σ

Expression method of average grain size: an electron microscope has be use to take a picture of a microstructure of a material, and observe grains of a hard magnetic phase $TbCu_7$ structure and grains of a soft magnetic phase α-Fe phase in the picture. The specific method includes: calculate the total cross-sectional area S of n grains of the same type, then make the cross-sectional area S equivalent to the area of a circle, calculate the diameter of the circle to obtain the average grain size a whose unit is nm, and the calculation formula is as follows:

$$\sigma = 2\sqrt{\frac{S}{\pi n}}$$

(3) Performance of Magnet Powder

The performance of magnet powder are detected by a Vibrating Sample Magnetometer (VSM), wherein Br is the remanence with kGs as the unit; Hcj is the intrinsic coercivity with kOe as the unit; (BH)m is the magnetic energy product with MGOe as the unit.

(4) Roughness Ra

The roughness is measured by a roughometer.

I. $Nd_xT_{100-x-y-a}C_yN_a$ Rare-Earth Permanent Magnetic Powder

The rare-earth permanent magnetic powders of example 1-16 are prepared by mixing the raw metals according to the proportions listed in Table 1 and put the metals in an induction melting furnace. Under the protection of gaseous Ar, alloy ingots are obtained by smelt, and then the alloy ingots are put in a rapid quenching furnace to be quenched rapidly after be roughly crushed, wherein the shielding gas is gaseous Ar, the jet pressure is 55 kPa, the number of nozzles is 2, the cross-sectional area is 0.85 $mm^2$, the water-cooling roller linear velocity is 50 m/s, the copper roller diameter is 300 mm; flaky alloy powder is obtained after the rapid quenching.

After being processed at 730° C. for 1.5 min under the protection of gaseous Ar, the alloy is nitrided at 430° C. for 6 hours by gaseous $N_2$ of one atmosphere to obtain nitride magnetic powder and XRD detection is performed for the obtained nitride magnetic powder.

Components, magnetic properties and grain sizes of the obtained flaky nitride magnetic powder are detected. The components and properties of the materials are as shown in Table 1. S represents an embodiment. Comparison examples are obtained from different components with the same process. D represents a comparison example.

TABLE 1

Material component, structures and properties

| Sample | Components (bal represents the remaining parts) | Ra | σ | Properties Br | Hcj | (BH)m |
|---|---|---|---|---|---|---|
| S1 | $Nd_{10.3}Fe_{bal}Co_{4.5}C_{0.8}N_{13.5}$ | 0.83 | 43 | 9.6 | 7.3 | 16.9 |
| S2 | $Nd_{8.3}Fe_{bal}Co_{4.5}C_{0.8}N_{12.5}$ | 0.8 | 56 | 9.1 | 7.6 | 16.6 |
| S3 | $Nd_{9.5}Fe_{bal}Co_{4.5}C_{0.1}N_{13.5}$ | 2.2 | 71 | 8.2 | 6.8 | 15.5 |
| S4 | $Nd_{8.9}Fe_{bal}Co_{15.5}C_{0.7}N_{15}$ | 1.3 | 45 | 9.5 | 7.4 | 16.7 |
| S5 | $Nd_{8.5}Fe_{bal}Co_{4.5}C_{0.9}N_{15.5}$ | 1.2 | 47 | 9.3 | 8.0 | 17.2 |
| S6 | $Nd_{5.1}Fe_{bal}Co_{4.5}C_{2.0}N_{13.5}$ | 1.4 | 59 | 8.4 | 7.3 | 16.4 |

TABLE 1-continued

Material component, structures and properties

| Sample | Components (bal represents the remaining parts) | Ra | σ | Properties Br | Hcj | (BH)m |
|---|---|---|---|---|---|---|
| S7 | $Nd_{8.9}Fe_{bal}C_{0.3}N_{13.5}$ | 2.2 | 26 | 8.1 | 6.5 | 14.7 |
| S8 | $Nd_{8.3}Fe_{bal}Co_{4.5}C_{0.6}N_{13.5}$ | 0.9 | 31 | 9.5 | 7.5 | 16.7 |
| S9 | $Nd_{12.0}Fe_{bal}Co_{11.5}C_{0.8}N_{20.0}$ | 2.8 | 38 | 8.1 | 6.8 | 15.1 |
| S10 | $Nd_{8.5}Fe_{bal}Co_{4.5}C_{0.9}N_{13.5}$ | 0.9 | 31 | 9.2 | 7.4 | 17.5 |
| S11 | $Nd_{8.3}Fe_{bal}Co_{4.5}C_{1.5}N_{13.5}$ | 1.8 | 61 | 8.4 | 7.0 | 16.1 |
| S12 | $Nd_{4.0}Fe_{bal}Co_{20.0}C_{0.5}N_{10.0}$ | 1.9 | 49 | 8.5 | 7.3 | 16.7 |
| S13 | $Nd_{8.3}Fe_{bal}Co_{6.5}C_{0.8}N_{13.5}$ | 0.5 | 43 | 9.4 | 7.5 | 17.6 |
| S14 | $Nd_{8.3}Fe_{bal}Co_{4.5}C_{0.8}N_{15}$ | 0.8 | 45 | 9.3 | 7.7 | 17.4 |
| S15 | $Nd_{9.3}Fe_{bal}Co_{4.5}C_{0.3}N_{13.5}$ | 1.7 | 52 | 8.3 | 6.9 | 14.4 |
| S16 | $Nd_{8.1}Fe_{bal}C_{0.2}N_{14.5}$ | 2.1 | 33 | 8.5 | 6.9 | 15.2 |
| D1 | $Sm_{9.0}Fe_{bal}Co_{4.5}N_{15}$ | 4.5 | 41 | 7.3 | 5.9 | 12.7 |
| D2 | $Nd_{9.0}Fe_{bal}Co_{4.5}C_{3.5}N_{15}$ | 3.1 | 46 | 7.9 | 6.4 | 13.9 |
| D3 | $Nd_{9.0}Fe_{bal}N_{15}$ | 3.7 | 40 | 7.1 | 6.1 | 11.6 |

It can be seen from corresponding results of examples 1 to 16 and comparison examples 1 to 3 that the ratio ranges of the raw materials can be controlled to obtain relatively high properties when the rare-earth permanent magnetic powder is prepared by element Nd, element C, element N and element T (T is Fe or FeCo). The surface roughness and magnetic properties will be reduced to different degrees especially when the content of element C in the prepared rare-earth permanent magnetic powder is not in the ranges required by the applications.

II. Rare-earth Permanent Magnetic Powder Added with Elements A (Zr and/or Hf) and B The rare-earth permanent magnetic powders of example 17-36 are prepared by mixing the raw metals according to the proportions listed in Table 2 and put the metals in an induction melting furnace. Under the protection of gaseous Ar, alloy ingots are obtained by smelt, and then the alloy ingots are put in a rapid quenching furnace to be quenched rapidly after be roughly crushed, wherein the shielding gas is gaseous Ar, the jet pressure is 20 kPa, the number of nozzles is 2, the cross-sectional area is 0.75 $mm^2$, the water-cooling roller linear velocity is 55 m/s, the copper roller diameter is 300 mm; flaky alloy powder is obtained after the rapid quenching.

After being processed at 730° C. for 10 min under the protection of gaseous Ar, the alloy is nitrided at 420° C. for 7 hours by gaseous $N_2$ of one atmosphere to obtain nitride magnetic powder.

Components, magnetic properties and grain sizes of the obtained flaky nitride magnetic powder are detected. The components and properties of the materials are as shown in Table 2. S represents an embodiment. Comparison examples are obtained from different components with the same process. D represents a comparison example.

TABLE 2

Material components, structures and properties

| Sample | Components (bal represents the remaining parts) | Ra | | Properties Br | Hcj | (BH)m |
|---|---|---|---|---|---|---|
| S17 | $Nd_{8.5}Zr_{1.1}Fe_{bal}Co_{4.5}C_{0.5}B_{0.5}N_{13.5}$ | 2.5 | 37 | 9.3 | 7.8 | 16.7 |
| S18 | $Nd_{8.5}Zr_{1.6}Fe_{bal}Co_{4.5}C_{0.5}B_{0.8}N_{13.5}$ | 2.9 | 39 | 7.6 | 7.7 | 15.5 |
| S19 | $Nd_{7.9}Zr_{2.1}Fe_{bal}Co_{4.5}C_{0.8}B_{0.8}N_{15.5}$ | 1.5 | 32 | 9.2 | 7.3 | 17.2 |
| S20 | $Nd_{7.3}Zr_{1.7}Fe_{bal}Co_{4.5}C_{0.3}B_{0.3}N_{13.5}$ | 2.4 | 49 | 7.9 | 5.3 | 15.8 |
| S21 | $Nd_{7.8}Zr_{1.6}Fe_{bal}Co_{4.5}C_{0.7}B_{0.8}N_{13.5}$ | 0.9 | 29 | 9.3 | 6.0 | 17.2 |
| S22 | $Nd_{8.5}Zr_{1.4}Fe_{bal}Co_{15.5}C_{0.8}B_{0.3}N_{15.5}$ | 1.1 | 38 | 9.1 | 6.2 | 16.9 |
| S23 | $Nd_{8.5}Zr_{2.5}Hf_{1.0}Fe_{bal}Co_{4.5}C_{0.5}B_{0.8}N_{15.5}$ | 2.5 | 41 | 8.1 | 6.6 | 15.7 |
| S24 | $Nd_{8.5}Zr_{1.7}Fe_{bal}Co_{4.5}C_{1.1}B_{0.8}N_{13.5}$ | 1.2 | 47 | 7.9 | 7.3 | 17.4 |
| S25 | $Nd_{8.5}Zr_{1.7}Fe_{bal}Co_{4.5}C_{0.9}B_{0.8}N_{13.5}$ | 1.3 | 48 | 7.2 | 7.6 | 16.9 |

TABLE 2-continued

| Material components, structures and properties | | | | | | |
|---|---|---|---|---|---|---|
| Sample | Components (bal represents the remaining parts) | Ra | | Properties Br | Hcj | (BH)m |
| S26 | $Nd_{7.5}Hf_{2.3}Fe_{bal}Co_{4.5}C_{1.4}B_{0.8}N_{13.5}$ | 2.3 | 41 | 8.3 | 7.7 | 16.3 |
| S27 | $Nd_{8.5}Zr_{1.5}Fe_{bal}Co_{4.5}C_{0.7}B_{0.8}N_{15.5}$ | 1.2 | 51 | 9.3 | 7.7 | 17.2 |
| S28 | $Nd_{6.5}Zr_{5.0}Fe_{bal}Co_{3.5}C_{1.4}B_{2.0}N_{13.5}$ | 2.3 | 87 | 8.4 | 8.0 | 16.4 |
| S29 | $Nd_{6.9}Zr_{1.5}Fe_{bal}Co_{4.5}C_{0.7}B_{0.3}N_{15.5}$ | 0.8 | 59 | 9.5 | 7.3 | 17.5 |
| S30 | $Nd_{6.3}Zr_{1.1}Fe_{bal}Co_{10.3}C_{0.8}B_{0.3}N_{15.5}$ | 0.9 | 61 | 9.3 | 7.1 | 17.2 |
| S31 | $Nd_{7.5}Zr_{1.6}Fe_{bal}Co_{4.5}C_{0.7}B_{0.8}N_{13.5}$ | 0.7 | 47 | 9.6 | 6.8 | 17.7 |
| S32 | $Nd_{3.0}Zr_{1.0}Hf_{0.2}Fe_{bal}Co_{11.5}C_{0.6}B_{0.1}N_{13.5}$ | 2.8 | 67 | 7.9 | 5.3 | 15.4 |
| S33 | $Nd_{8.5}Zr_{1.7}Fe_{bal}Co_{4.5}C_{1.1}B_{0.8}N_{17.5}$ | 1.6 | 64 | 6.8 | 6.5 | 15.9 |
| S34 | $Nd_{6.9}Zr_{1.5}Fe_{bal}Co_{4.5}C_{0.7}B_{0.3}N_{25}$ | 0.9 | 71 | 6.5 | 5.9 | 15.3 |
| S35 | $Nd_{9.1}Zr_{1.3}Fe_{bal}Co_{4.5}C_{1.1}B_{0.6}N_{13.5}$ | 1.4 | 43 | 9.2 | 7.5 | 17.0 |
| S36 | $Nd_{8.4}Hf_{1.6}Fe_{bal}Co_{4.5}C_{1.5}B_{0.8}N_{13.5}$ | 2.2 | 79 | 8.4 | 7.8 | 16.2 |
| D4 | $Nd_{6.3}Zr_{1.1}Fe_{bal}Co_{10.3}C_{0.8}B_{0.3}N_{15.5}$ | 3.2 | 83 | 6.8 | 5.7 | 8.6 |
| D5 | $Nd_{6.0}Zr_{1.5}Fe_{bal}Co_{11.5}C_{0.6}B_{0.1}N_{13.5}$ | 4.7 | 76 | 6.9 | 6.4 | 9.0 |
| D6 | $Nd_{6.3}Zr_{0.3}Fe_{bal}Co_{10.3}C_{0.8}B_{0.3}N_{15.5}$ | 3.1 | 91 | 7.1 | 6.1 | 9.8 |

It can be seen from the contents of Table 2 that, after adding element A and element B, the rare-earth permanent magnetic powder of the applications can obtain relatively high properties through controlling the ranges of ratios of the raw materials. Optimal surface states and magnetic properties can be obtained especially when the ratio of element B to element A is controlled between 0.1 and 0.5 while the ratio of C to the sum of A and Nd is controlled in the range of 0.05 and 0.12. At the same time, it can be learned from the embodiments that the magnetic properties are reduced beyond the ranges of the ratios.

III. Rare-earth Permanent Magnetic Powder Added with Element M

The rare-earth permanent magnetic powder is prepared by element Nd, element C, element N, element T (T is Fe or FeCo), and element M, wherein element M is at least one of Ti, V, Cr, Ni, Cu, Nb, Mo, Ta, W, Al, Ga and Si.

The rare-earth permanent magnetic powders of example s37-s53 are prepared by mixing the raw metals according to the proportions listed in Table 3 and put the metals in an induction melting furnace. Under the protection of gaseous Ar, alloy ingots are obtained by smelt, the alloy ingots are put in a rapid quenching furnace to be quenched rapidly after be roughly crushed, wherein the shielding gas is gaseous Ar, the jet pressure is 35 kPa, the number of nozzles is 1, the cross-sectional area is 0.9 $mm^2$, the water-cooling roller linear velocity is 65 m/s, the copper roller diameter is 300 mm; flaky alloy powder is obtained after the rapid quenching.

After being processed at 750° C. for 10 min under the protection of gaseous Ar, the alloy is nitrided at 430° C. for 6 hours by gaseous $N_2$ of one atmosphere to obtain nitride magnetic powder.

XRD detection is performed for the obtained nitride magnetic powder. Components, magnetic properties and grain sizes of the obtained flaky nitride magnetic powder are detected. The components and properties of the materials are as shown in Table 3. S represents an embodiment. Comparison examples are obtained from different components with the same process. D represents a comparison example.

TABLE 3

| Material Components, structures and properties | | | | | | |
|---|---|---|---|---|---|---|
| Sample | Components (bal represents the remaining parts) | Ra | σ | Properties Br | Hcj | (BH)m |
| S37 | $Nd_{8.5}Fe_{bal}Co_{4.5}Mo_{2.4}C_{0.8}N_{13.5}$ | 1.5 | 23 | 8.8 | 6.2 | 15.4 |
| S38 | $Nd_{8.5}Fe_{bal}Co_{3.5}Ta_{2.4}C_{0.8}N_{13.5}$ | 1.4 | 31 | 8.6 | 5.5 | 15.4 |
| S39 | $Nd_{8.5}Fe_{bal}Co_{4.5}Nb_{2.4}C_{0.8}N_{12.5}$ | 1.5 | 29 | 8.8 | 6.9 | 15.6 |
| S40 | $Nd_{8.5}Fe_{bal}Co_{4.5}Ga_{2.4}C_{0.8}N_{13.6}$ | 0.9 | 23 | 8.9 | 6.1 | 15.5 |
| S41 | $Nd_{8.5}Fe_{bal}Co_{5.0}Si_{2.4}C_{0.8}N_{12.5}$ | 0.8 | 31 | 9.0 | 6.5 | 15.4 |
| S42 | $Nd_{8.5}Fe_{bal}Co_{4.5}Al_{10.0}C_{0.8}N_{12.5}$ | 1.3 | 65 | 8.1 | 7.1 | 14.1 |
| S43 | $Nd_{8.5}Fe_{bal}Ga_{5.0}C_{0.8}N_{12.2}$ | 1.3 | 31 | 8.6 | 7.3 | 15.7 |
| S44 | $Nd_{8.5}Fe_{bal}Co_{4.5}Si_{0.5}C_{0.8}N_{13.2}$ | 1.2 | 41 | 8.5 | 5.7 | 15.0 |
| S45 | $Nd_{8.5}Fe_{bal}Co_{4.5}Zr_{0.4}Ga_{2.4}C_{0.8}N_{14.0}$ | 0.75 | 35 | 8.6 | 6.0 | 15.2 |
| S46 | $Nd_{8.5}Fe_{bal}Co_{1.5}Al_{2.4}C_{1.3}N_{13.5}$ | 0.5 | 19 | 8.7 | 6.7 | 15.3 |
| S47 | $Nd_{9.2}Fe_{bal}Co_{4.5}Nb_{3.4}C_{0.8}N_{12.5}$ | 1.2 | 45 | 8.5 | 7.1 | 15.0 |
| S48 | $Nd_{6.2}Fe_{bal}Co_{6.9}Ti_{4.3}V_{2.2}N_{12.3}$ | 1.6 | 54 | 8.2 | 7.3 | 14.9 |
| S49 | $Nd_{7.3}Fe_{bal}Co_{21.0}Al_{1.3}Ta_{0.2}Mo_{4.2}N_{12.5}$ | 1.9 | 71 | 8.5 | 6.2 | 14.9 |
| S50 | $Nd_{6.2}Fe_{bal}Co_{11.9}Si_{3.3}W_{1.5}Ni_{5.2}N_{12.3}$ | 2.5 | 100 | 8.3 | 6.7 | 13.1 |
| S51 | $Nd_{7.3}Fe_{bal}Co_{21.0}Al_{1.3}Cr_{0.2}Si_{0.2}N_{12.5}$ | 1.5 | 56 | 8.6 | 6.0 | 15.2 |
| S52 | $Nd_{6.2}Fe_{bal}Co_{11.9}Al_{0.5}Cu_{1.5}Ni_{0.2}N_{12.3}$ | 1.5 | 47 | 8.5 | 5.6 | 15.1 |
| S53 | $Nd_{6.2}Fe_{bal}Co_{11.9}Al_{0.3}N_{13.8}$ | 2.3 | 62 | 8.2 | 6.4 | 14.2 |
| D7 | $Sm_{9.0}Fe_{bal}Co_{4.5}Al_{0.4}Ga_{2.4}N_{15}$ | 3.5 | 89 | 6.9 | 5.1 | 9.2 |
| D8 | $Nd_{9.0}Fe_{bal}Co_{4.5}C_{3.5}Si_{0.4}Ga_{2.4}N_{15}$ | 3.1 | 55 | 7.1 | 5.7 | 10.9 |
| D9 | $Nd_{9.0}Fe_{bal}Nb_{0.4}Ga_{2.4}N_{15}$ | 4.2 | 63 | 7.3 | 5.5 | 11.2 |

It can be learned from the contents of Table 3 that the addition of a certain amount of M may also obtain a relatively low value of the surface roughness. However, compared with rare-earth permanent magnetic powder without M, the magnetic properties are reduced somewhat and the surface roughness and magnetic properties will be reduced to different degrees especially when the components deviate from the ranges required by the application.

IV. Rare-earth Permanent Magnetic Powder Added with Element M

The rare-earth permanent magnetic powder is prepared by element Nd, element C, element N, element T (T is Fe or FeCo), element A, element B and element M, wherein element M is at least one of Ti, V, Cr, Ni, Cu, Nb, Mo, Ta, W, Al, Ga and Si.

The rare-earth permanent magnetic powders of example s54-s63 are prepared by mixing the raw metals according to the proportions listed in Table 4 and put the rare-earth and transition metals in an induction melting furnace. Under the protection of gaseous Ar, alloy ingots are obtained by smelt, and then put the alloy ingots in a rapid quenching furnace to be quenched rapidly after be roughly crush, wherein the shielding gas is gaseous Ar, the jet pressure is 30 kPa, the number of nozzles is 3, the cross-sectional area is 0.83 $mm^2$, the water-cooling roller linear velocity is 61 m/s, the copper roller diameter is 300 mm; flaky alloy powder is obtained after the rapid quenching.

After being processed at 700° C. for 10 min under the protection of gaseous Ar, the alloy is nitrided at 420° C. for 5.5 hours by gaseous $N_2$ of one atmosphere to obtain nitride magnetic powder.

XRD detection is performed for the obtained nitride magnetic powder. Components, magnetic properties and grain sizes of the obtained flaky nitride magnetic powder are detected. The components and properties of the materials are as shown in Table 4. S represents an embodiment.

TABLE 4

Material Components, structures and properties

| Sample | Components (bal represents the remaining parts) | Ra | σ | Properties Br | Hcj | (BH)m |
|---|---|---|---|---|---|---|
| S54 | $Nd_{7.8}Zr_{1.6}Fe_{bal}Co_{4.5}Nb_{2.5}C_{0.7}B_{0.8}N_{13.5}$ | 1.6 | 47 | 8.7 | 5.7 | 15.9 |
| S55 | $Nd_{8.5}Zr_{1.4}Fe_{bal}Co_{15.5}Ga_{2.5}C_{0.8}B_{0.3}N_{15.5}$ | 1.8 | 42 | 8.1 | 4.9 | 15.6 |
| S56 | $Nd_{6.9}Hf_{1.5}Fe_{bal}Co_{4.5}Si_{2.5}C_{0.7}B_{0.3}N_{15.5}$ | 1.6 | 53 | 8.4 | 6.0 | 15.5 |
| S57 | $Nd_{6.3}Zr_{1.1}Fe_{bal}Co_{10.3}Al_{12.5}C_{0.8}B_{0.3}N_{15.5}$ | 2.0 | 59 | 8.3 | 6.4 | 16.3 |
| S58 | $Nd_{7.5}Zr_{1.6}Fe_{bal}Co_{4.5}Ga_{1.9}Si_{3.1}C_{0.7}B_{0.8}N_{13.5}$ | 1.9 | 37 | 8.1 | 7.5 | 15.6 |
| S59 | $Nd_{7.8}Zr_{1.5}Fe_{bal}Co_{4.5}Al_{1.5}Si_{0.3}C_{0.7}B_{0.75}N_{13.5}$ | 2.2 | 29 | 8.2 | 5.5 | 15.3 |
| S60 | $Nd_{8.5}Hf_{1.4}Fe_{bal}Co_{15.5}Ga_{1.3}Si_{0.8}C_{0.8}B_{0.3}N_{15.5}$ | 2.5 | 76 | 8.9 | 6.2 | 16.2 |
| S61 | $Nd_{6.9}Zr_{1.0}Hf_{0.5}Fe_{bal}Co_{4.5}C_{0.7}W_{0.1}Cr_{1.5}B_{0.3}N_{15.5}$ | 2.4 | 59 | 8.5 | 5.9 | 16.1 |
| S62 | $Nd_{6.3}Zr_{1.1}Fe_{bal}Co_{9.3}Cu_{2.1}Mo_{0.4}C_{0.8}B_{0.3}N_{15.5}$ | 2.3 | 43 | 8.1 | 4.7 | 15.9 |
| S63 | $Nd_{7.5}Zr_{0.8}Hf_{0.7}Fe_{bal}Co_{4.5}Ta_{2.3}C_{0.7}B_{0.75}N_{13.5}$ | 2.5 | 61 | 8.7 | 5.6 | 16.1 |

It can be learned from the contents of Table 4 that the addition of a certain amount of M may also obtain a relatively low value of the surface roughness. However, compared with rare-earth permanent magnetic powder without M, the magnetic properties are reduced somewhat and the surface roughness and magnetic properties will be reduced to different degrees especially when the components deviate from the ranges required by the application.

V. Influence of Other Rare-earth Elements on the Magnetic Properties of the Rare-earth Permanent Magnetic Powder Provided by the Application The rare-earth permanent magnetic powders of example s64-s71 are prepared by mixing the rare-earth and transition metals according to the proportions listed in Table 5 and put the rare-earth and transition metals in an induction melting furnace. Under the protection of gaseous Ar, alloy ingots are obtained by smelt, the alloy ingots are put in a rapid quenching furnace to be quenched rapidly after be roughly crushed, wherein the shielding gas is gaseous Ar, the jet pressure is 45 kPa, the number of nozzles is 4, the cross-sectional area is 0.75 $mm^2$, the water-cooling roller linear velocity is 60 m/s, the copper roller diameter is 300 mm; flaky alloy powder is obtained after the rapid quenching.

After being processed at 700° C. for 10 min under the protection of gaseous Ar, the alloy is nitrided at 430° C. for 6 hours by gaseous $N_2$ of one atmosphere to obtain nitride magnetic powder.

XRD detection is performed for the obtained nitride magnetic powder. Components, magnetic properties and grain sizes of the obtained flaky nitride magnetic powder are detected. The components and properties of the materials are as shown in Table 5. S represents an example.

TABLE 5

| Material Components, structures and properties | | | | | | |
|---|---|---|---|---|---|---|
| | Components (bal represents the remaining | | | Properties | | |
| Sample | parts) | Ra | σ | Br | Hcj | (BH)m |
| S64 | $Nd_{7.3}Sm_{1.2}Fe_{bal}Co_{4.5}C_{0.8}N_{13.5}$ | 2.4 | 61 | 7.5 | 6.8 | 12.8 |
| S65 | $Nd_{8.3}Ce_{1.5}Fe_{bal}Co_{4.5}C_{0.8}N_{12.5}$ | 2.3 | 57 | 6.9 | 6.6 | 9.6 |
| S66 | $Nd_{6.5}Sm_{4.0}Fe_{bal}Co_{4.5}C_{0.9}N_{15.5}$ | 2.5 | 43 | 7.2 | 6.8 | 12.5 |
| S67 | $Nd_{6.3}Ce_{0.5}Zr_{1.1}Fe_{bal}Co_{10.3}C_{0.8}B_{0.3}N_{15.5}$ | 2.6 | 47 | 6.1 | 6.4 | 10.6 |
| S68 | $Nd_{5.5}Sm_{3.7}Zr_{1.5}Fe_{bal}Co_{4.5}C_{0.7}B_{0.8}N_{13.5}$ | 2.7 | 49 | 6.8 | 6.2 | 10.2 |
| S69 | $Nd_{7.8}Ce_{1.3}Zr_{1.5}Fe_{bal}Co_{4.5}C_{0.7}B_{0.8}N_{13.5}$ | 2.6 | 39 | 5.7 | 6.0 | 10.9 |
| S70 | $Nd_{7.8}Ce_{0.9}Zr_{1.6}Fe_{bal}Co_{4.5}Nb_{2.5}C_{0.7}B_{0.8}N_{13.5}$ | 1.6 | 47 | 8.7 | 1.6 | 11.3 |
| S71 | $Nd_{8.5}Sm_{1.3}Zr_{1.4}Fe_{bal}Co_{15.5}Ga_{2.5}C_{0.8}B_{0.3}N_{15.5}$ | 1.8 | 42 | 8.1 | 1.8 | 11.1 |

According to the description above, the $TbCu_7$ structure rare-earth nitride magnetic powder provided by the application is provided with optimized components and can effectively avoid problems including rare-earth volatilization and bad wettability etc. in the preparation process to obtain a material with uniform phase structures and microstructure and high magnetic properties.

In addition, according to the application, the magnetic powder may be mixed and bonded with a binder to prepare a bonded magnet to be applied in occasions including motors, stereos, and measurement instruments etc.

The above are only preferred embodiments of the application and should not be used for limiting the application. For those skilled in the art, the application may have various modifications and changes. Any modifications, equivalent replacements, improvements and the like within the spirit and principle of the application shall fall within the scope of protection of the application.

What we claim is:

1. A rare-earth permanent magnetic powder, wherein the rare-earth permanent magnetic powder comprises 4 to 12 at. % of Nd (neodymium), 0.1 to 2 at. % of C (carbon), 10 to 25 at. % of N (nitrogen) and 62.2 to 85.9 at. % of element T, wherein the element T is Fe or FeCo, and the main phase of the rare-earth permanent magnetic powder is a hard magnetic phase with a $TbCu_7$ structure, wherein the rare-earth permanent magnetic powder further comprises 1 to 5 at. % of element A and a 0.1 to 2 at. % of B (boron); the element A is Zr and/or Hf, the ratio of the content of B (boron) to the element of A is 0.1 to 0.5.

2. The rare-earth permanent magnetic powder according to claim 1, wherein the rare-earth permanent magnetic powder has the structure in General Formula (II), and the General Formula (II) is shown as follows:

$$Nd_xA_wT_{100-x-y-z-a}C_yB_zN_a \quad \text{(II)},$$

wherein element T is Fe (iron) or FeCo (iron-cobalt); element A is Zr (zirconium) and/or Hf (hafnium);

$5 \le x+w \le 12$, $1 \le w \le 5$, $0.1 \le z \le 2$, $10 \le a \le 25$, $0.1 \le z/w \le 0.5$ and $0.1 \le y \le 2$.

3. The rare-earth permanent magnetic powder according to claim 1, wherein the content of B (boron) in the rare-earth permanent magnetic powder ranges from 0.3 to 2 at. %.

4. The rare-earth permanent magnetic powder according to claim 1, wherein the contents of Nd (neodymium) and element A in the rare-earth permanent magnetic powder are 5 to 12 at. % of the total contents of the rare-earth permanent magnetic powder, and the ratio of the content of C (carbon) to the sum of the contents of Nd (neodymium) and element A in the rare-earth permanent magnetic powder is 0.03 to 0.15.

5. The rare-earth permanent magnetic powder according to claim 4, wherein the ratio of the content of C (carbon) to the sum of the contents of Nd (neodymium) and element A in the rare-earth permanent magnetic powder is 0.05 to 0.12.

6. The rare-earth permanent magnetic powder according to claim 4, wherein the rare-earth permanent magnetic powder has the structure in General Formula (II), and the General Formula (II) is shown as follows:

$$Nd_xA_wT_{100-x-y-z-a}C_yB_zN_a \quad \text{(II)}$$

wherein element T is Fe (iron) or FeCo(iron-cobalt); element A is Zr (zirconium) and/or Hf (hafnium);

$5 \le x+w \le 12$, $1 \le w \le 5$, $0.1 \le z \le 2$, $10 \le a \le 25$, $0.1 \le z/w \le 0.5$ and $0.1 \le y \le 2$.

7. The rare-earth permanent magnetic powder according to claim 1, wherein the rare-earth permanent magnetic powder further comprises 0.3 to 10 at. % of element M, and the element M is at least one of Ti (titanium), V (vanadium), Cr (chromium), Ni (nickel), Cu (copper), Nb (niobium), Mo (molybdenum), Ta (tantalum), W (tungsten), Al (aluminum), Ga (gallium) and Si (silicon).

8. The rare-earth permanent magnetic powder according to claim 7, wherein the content of element M in the rare-earth permanent magnetic powder is 0.5 to 8 at. %.

9. The rare-earth permanent magnetic powder according to claim 8, wherein the content of element M in the rare-earth permanent magnetic powder is 0.5 to 5 at. %, and the element M is at least one of Nb (niobium), Ga (gallium), Al (aluminum)and Si (silicon).

10. The rare-earth permanent magnetic powder according to claim 1, wherein the roller contact surface roughness Ra of the rare-earth permanent magnetic powder is below 2.8 μm.

11. The rare-earth permanent magnetic powder according to claim 1, wherein the average grain size of the rare-earth permanent magnetic powder is 3 to 100 nm.

12. The rare-earth permanent magnetic powder according to claim 1, wherein the Nd (neodymium) in the rare-earth permanent magnetic powder is partly substituted by Sm (samarium) and/or Ce (cerium); the content of Sm (samarium) and/or Ce (cerium) in the rare-earth permanent magnetic powder is 0.5 to 4.0 at. %.

13. A bonded magnet, wherein the bonded magnet is obtained by bonding the rare-earth permanent magnetic powder according to claim 1 with a binder.

14. A device, wherein the device uses the bonded magnet according to claim 13.

15. The rare-earth permanent magnetic powder according to claim 1, wherein the roller contact surface roughness Ra is below 1.6 μm.

* * * * *